US006634286B1

(12) United States Patent
Carstens

(10) Patent No.: US 6,634,286 B1
(45) Date of Patent: Oct. 21, 2003

(54) ENGRAVING MECHANISM FOR ELECTRONIC ENGRAVING MACHINES

(75) Inventor: Hans Dieter Carstens, Kiel (DE)

(73) Assignee: Hell Gravure Systems GmbH, Kiel (DE)

( * ) Notice: Subject to any disclaimer, the term of this patent is extended or adjusted under 35 U.S.C. 154(b) by 0 days.

(21) Appl. No.: 10/110,760

(22) PCT Filed: Oct. 27, 2000

(86) PCT No.: PCT/DE00/03790

§ 371 (c)(1),
(2), (4) Date: Jul. 2, 2002

(87) PCT Pub. No.: WO01/32419

PCT Pub. Date: May 10, 2001

(30) Foreign Application Priority Data

Nov. 4, 1999 (DE) ..... 199 52 996

(51) Int. Cl.[7] ..... B41F 1/07

(52) U.S. Cl. ..... 101/3.1; 101/28; 358/3.31; 358/3.32; 700/160

(58) Field of Search ..... 101/3.1, 28, 401.1, 101/481; 358/3.31, 3.32, 3.29; 700/160; 409/131, 208, 104, 159, 165

(56) References Cited

U.S. PATENT DOCUMENTS 3,964,382 A 6/1976 Baar et al.
4,357,633 A * 11/1982 Buechler ..... 358/3.32
5,029,011 A * 7/1991 Fraser ..... 409/208
5,454,306 A * 10/1995 Fraser et al. ..... 101/28
5,822,078 A * 10/1998 Hirai et al. ..... 358/3.32
6,007,230 A * 12/1999 Beckett et al. ..... 700/160
6,025,921 A * 2/2000 Beckett et al. ..... 358/1.1
6,269,718 B1 * 8/2001 Fraser et al. ..... 82/1.11
6,421,576 B1 * 7/2002 Sermund ..... 700/160
6,515,772 B1 * 2/2003 Holowko et al. ..... 358/3.29
6,525,839 B1 * 2/2003 Beckett et al. ..... 358/3.31

FOREIGN PATENT DOCUMENTS

| | | |
|---|---|---|
| DE | 23 36 089 | 2/1975 |
| DE | 25 08 734 | 8/1976 |
| DE | 298 12 163 | 11/1998 |
| DE | 198 05 179 | 8/1999 |
| WO | WO 95/02502 | 1/1995 |

* cited by examiner

*Primary Examiner*—Eugene H. Eickholt
(74) *Attorney, Agent, or Firm*—Schiff Hardin & Waite

(57) ABSTRACT

An engraving element of an electronic engraving machine for engraving printing cylinders as a shaft oscillating with small rotational angles around the longitudinal axis, a restoring element, a shaft bearing, a damping mechanism, a drive for the shaft, a lever-shaped stylus holder attached to the shaft, and an engraving stylus as a cutting tool. For engraving cups, the engraving stylus executes a stroke motion in the direction of a rotating printing cylinder. The engraving element is arranged with respect to the printing cylinder rotating around the rotational axis such that the shaft of the engraving element proceeds substantially parallel to the rotational axis of the printing cylinder, and the stroke motion of the engraving stylus occurs in a plane oriented perpendicular to the rotational axis of the printing cylinder. As a result, a better geometry of the cups is achieved in the engraving.

36 Claims, 5 Drawing Sheets

ENGRAVING MECHANISM FOR ELECTRONIC ENGRAVING MACHINES

BACKGROUND OF THE INVENTION

The invention is in the field of electronic reproduction technology and is directed to an engraving element for an electronic engraving machine for engraving printing cylinders, and to an electronic engraving machine having such an engraving element.

DE-C-2508734 already discloses an electronic engraving machine for engraving printing cylinders with an engraving element. The engraving element has an engraving stylus controlled by an engraving control signal as a cutting tool and moves in an axial direction along a rotating printing cylinder. The engraving stylus cuts a sequence of cups arranged in a printing raster into the generated surface cylinder. The engraving control signal is formed by a superimposition of a periodic raster signal for generating the printing raster with image signal values that define the tonal values to be reproduced between "black" and "white". Whereas the raster signal effects an oscillating lifting motion of the engraving stylus for engraving the cups arranged in the printing raster, the image signal values determine the cut depths of the engraved cups corresponding to the tonal values to be reproduced.

DE-A-23 36 089 discloses an engraving element that essentially comprises a rotatory system and an electromagnetic drive for the rotatory system. The rotatory system is comprises of a shaft, an armature, a bearing for the shaft, a restoring element and of a damping mechanism. A lever-shaped stylus holder is attached to the shaft, this carrying the engraving stylus. The electromagnetic drive for the rotatory system comprises a stationary electromagnet charged with the engraving control signal in whose air gap the armature of the rotatory system moves. The drive effects a rotatory motion of the shaft oscillating by small angles, and the stylus holder together with the engraving stylus implements a corresponding, oscillating lifting motion in the direction of the generated surface of the printing cylinder for engraving the cups.

U.S. Pat. No. 4,450,486 discloses an engraving element having a similar design structure.

Given the engraving elements disclosed by DE-A-23 36 089 and U.S. Pat. No. 4,450,486, the components of the engraving element are arranged such with respect to the printing cylinder to be engraved that the oscillating shaft of the rotatory system is aligned approximately tangentially relative to the printing cylinder, and the lifting motion of the engraving stylus ensues in a plane proceeding diametrically through the printing cylinder.

The position of the shaft of a traditional engraving element with respect to the printing cylinder has the disadvantage that forces arising upon penetration of the engraving stylus into the printing cylinder attack asymmetrically at the stylus holder and the engraving stylus, which can be expressed in an asymmetrical geometry of the engraved cups given inadequate mechanical stiffness. Another disadvantage is that, due to the position of the shaft, a heating of the engraving element can lead to faulty cut depths of the cups and, thus, to undesired changes in tonal value.

SUMMARY OF THE INVENTION

It is an object of the invention to design an engraving element for an electronic engraving machine for engraving printing cylinders as well as an electronic engraving machine having an engraving element such that an improved geometry of the engraved cups and, thus, an improved engraving quality are achieved.

According to the invention, an engraving element of an electronic engraving machine is provided for engraving a printing cylinder. A shaft oscillates with small rotational angles around a longitudinal axis. A drive is provided for the shaft. A lever-shaped stylus holder is attached to the shaft and has an engraving stylus as a cutting tool which, for engraving, executes a stroke motion in a direction onto a generated surface of the printing cylinder rotating around a rotational axis. The engraving element is arranged with respect to the printing cylinder rotating around the rotational axis such that the shaft proceeds substantially parallel to the rotational axis of the printing cylinder. A stroke motion of the engraving stylus occurs in a plane oriented perpendicular to the rotational axis of the printing cylinder.

DESCRIPTION OF THE PREFERRED EMBODIMENTS

Figure 1:
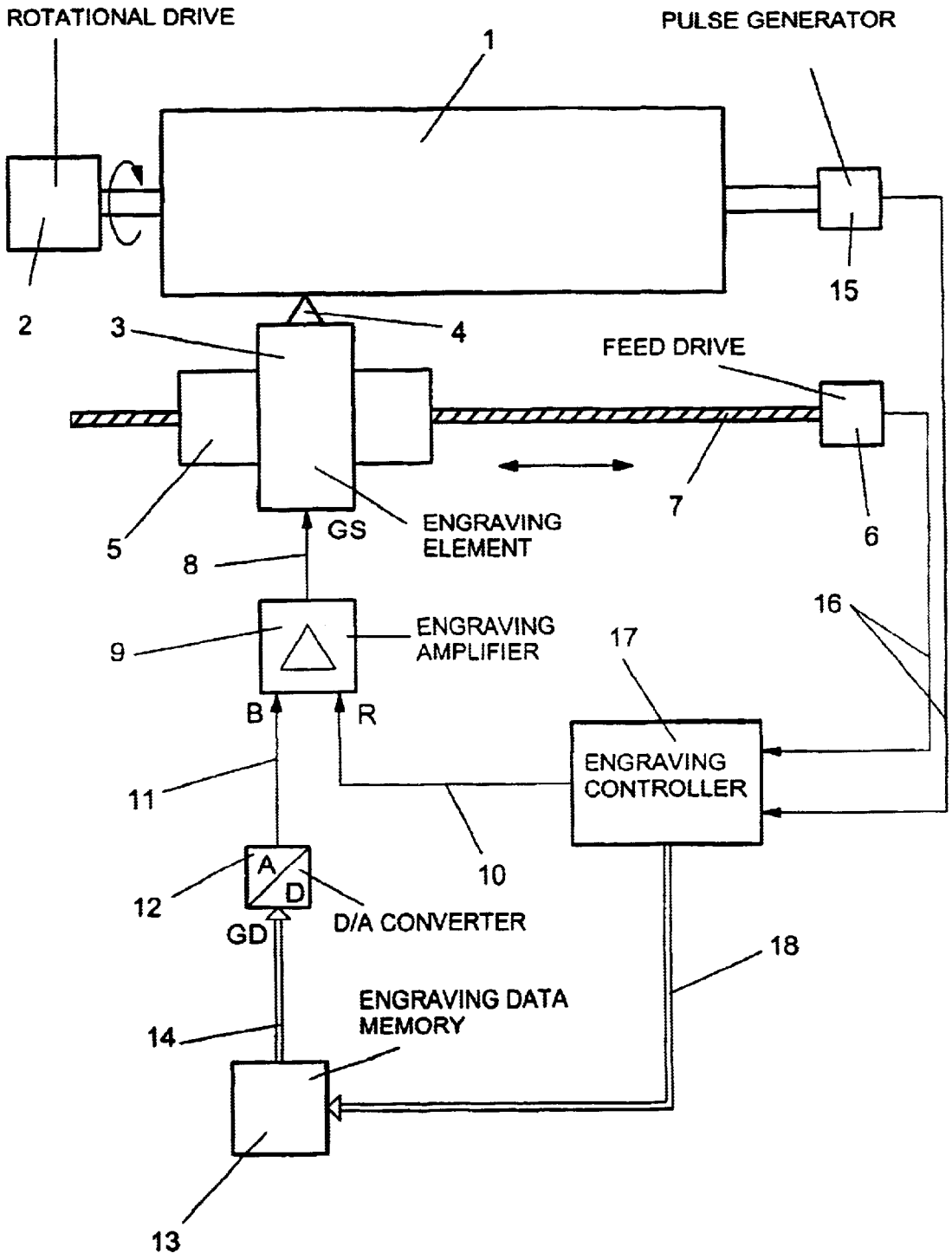
Fig. 1 (PRIOR ART)
FIG. 1 is a block circuit diagram of an electronic engraving machine having an engraving element (prior art)

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

FIG. 1 shows a block circuit diagram of an electronic engraving machine of the prior art. For example, the engraving machine is a HelioKlischograph® of Hell Gravure Systems GmbH, Kiel, Del.

A printing cylinder 1 is driven by a rotational drive 2. An engraving element 3 having an engraving stylus 4 as a cutting tool is mounted on an engraving carriage 5 that is movable in an axial direction of the printing cylinder 1 with the assistance of a spindle 7 driven by a feed drive 6. The engraving element 3, is, for example, equipped with an electromagnetic drive for the engraving stylus 4.

The engraving stylus 4 controlled by an analog engraving control signal GS on a line 8 cuts a sequence of cups arranged in a printing raster into the generated surface of the rotating printing cylinder 1 that are arranged in a printing raste. The engraving carriage 5 with the engraving element 3 moves along the printing cylinder 1 in the axial direction either step-by-step or continuously for surface rise engraving.

The engraving control signal GS is generated in an engraving amplifier 9 by superimposition of a periodic raster signal R for generating the printing raster on a line 10 with image signal values (B) on a line 11, said image signal values B defining the tonal values between "light" and "dark" of the cups to be engraved. Whereas the raster signal R effects an oscillating lifting motion of the engraving stylus 4 for engraving the cups arranged in the printing raster, the image signal values B define the cut depths of the cups corresponding to the tonal values to be reproduced. The image signal values B are acquired in a D/A converter 12 from engraving data GD of the printing form to be engraved. The engraving data GD are deposited in an engraving data memory 13 from which they are read out engraving line by engraving line and supplied to the D/A converter 12 via a data bus 4.

The engraving locations of the cups on the printing cylinder 1 prescribed by the printing raster are defined by the location coordinates (x, y) of a coordinate system allocated to the generated surface of the printing cylinder 1 whose X-axis is aligned in the axial direction and whose Y-axis is aligned in the circumferential direction of the printing cylinder 1. The feed drive 6 generates the x-location coordinates and a pulse generator 15 mechanically coupled to the printing cylinder 1 generates the y-location coordinates. The xy location coordinates are supplied to an engraving controller 17 via lines 16. The engraving controller 17 generates the raster signal R on a line 10, read addresses for the engraving data memory 13 on an address bus 18, as well as signals for the control and synchronization of the engraving sequence.

Figure 2:
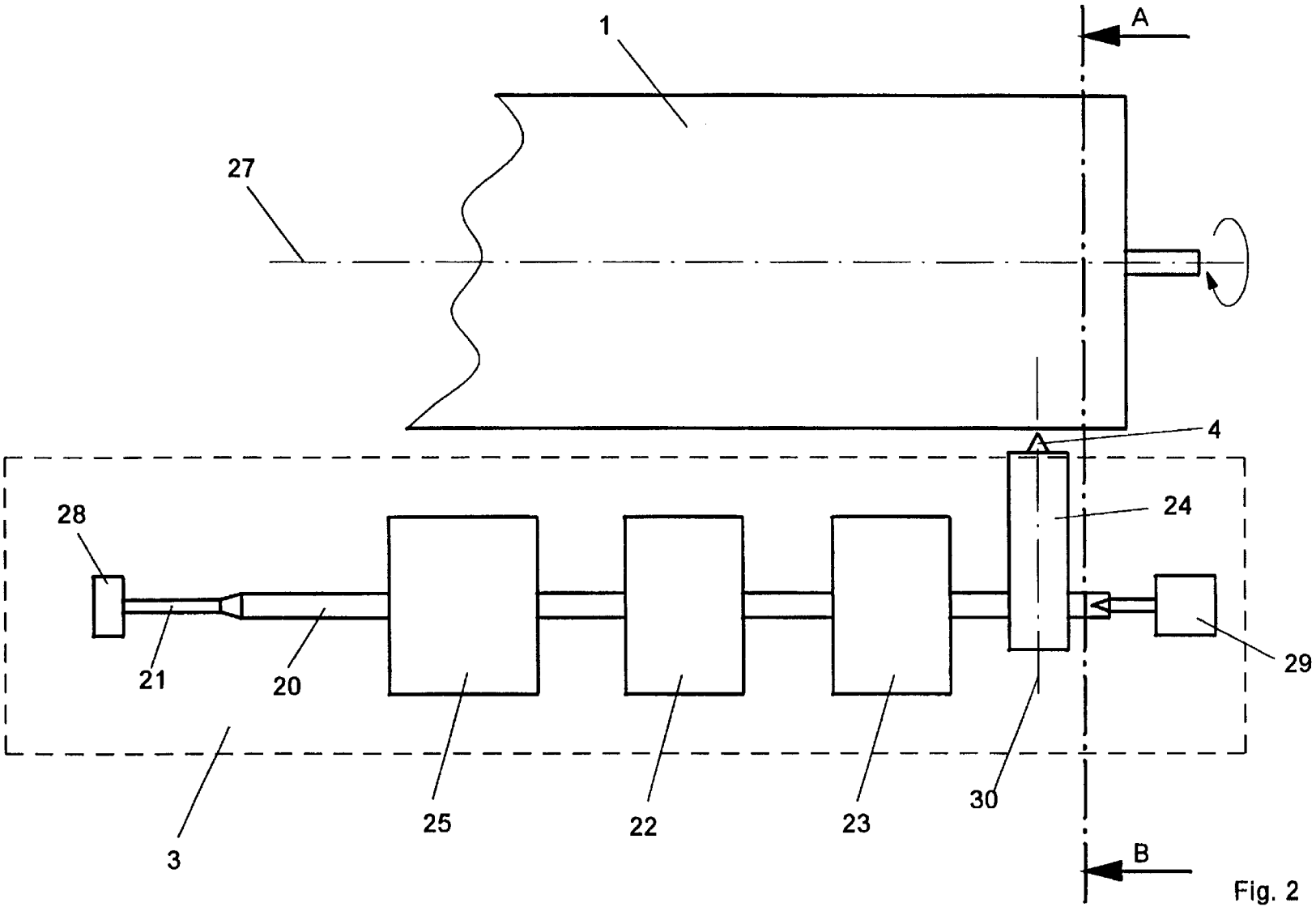
FIG. 2 is a first schematic exemplary embodiment of the engraving element.

FIG. 2 shows a first schematic exemplary embodiment of the engraving element 3 for engraving the printing cylinder 1. The engraving element 3 is essentially comprised of an oscillating rotatory system and of a drive for the rotatory system designed as an electromagnetic drive in the exemplary embodiment.

The rotatory system comprises a shaft 20, a torsion rod 21, a shaft bearing 22, a damping mechanism 23, a stylus holder 24 and an armature 25. The shaft 20 lies parallel to the rotational axis 27 of the printing cylinder 1. One end of the shaft 20 is designed as a resilient torsion rod 21 secured in a stationary chucking 28 and forms the restoring element of the rotatory system. The shaft bearing 22, is, for example, a spoke bearing according to German Utility Model application G 298 12 163.8. The damping mechanism 23, for example according to German Patent Application P 198 30 471.4, comprises a stationary damping chamber filled with a damping medium in which a damping disk connected to the shaft 20 moves. The stylus holder 24 designed lever-shaped is attached to that end of the shaft 20 lying opposite the torsion rod 21 with radial alignment in the described exemplary embodiment and carries the engraving stylus 4.

The damping mechanism 23 and the shaft bearing 22 in the first exemplary embodiment are arranged between the armature 25 and the stylus holder 24. Damping mechanism 23 and shaft bearing 22 can also be designed as a structural unit. Additionally, the end of the shaft 20 to which the stylus holder 24 is secured can also be supported by a further shaft bearing 29.

Figure 3:
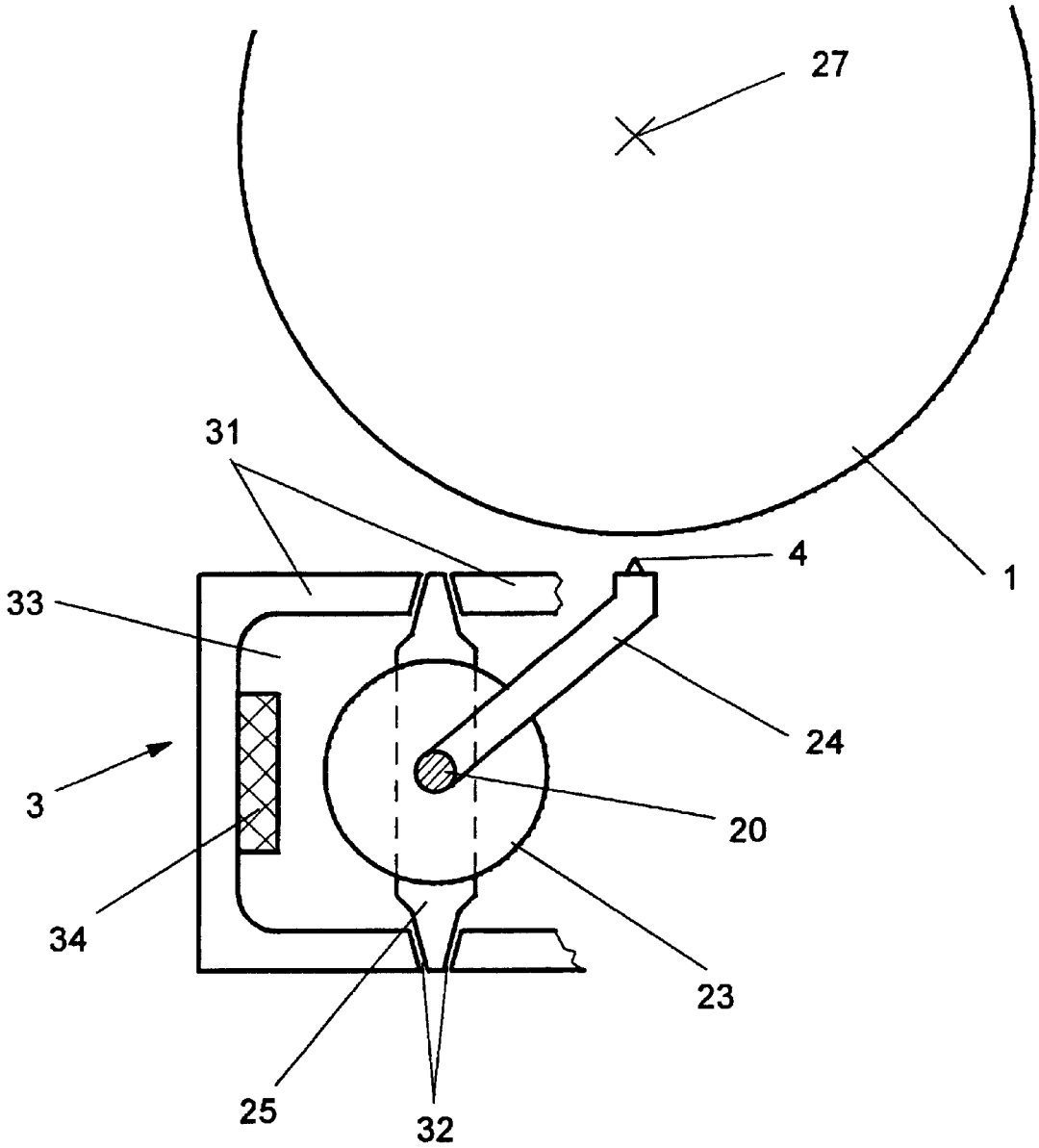
FIG. 3 is a cross-sectional view of engraving element and printing cylinder.

The electromagnetic drive for the rotatory system is comprised of a stationary electromagnet 26 which is shown in FIG. 3, and the armature 25 seated on the shaft 20. The electromagnet 26 is charged with the engraving control signal GS comprised of the periodic raster signal R and of the image signal values B. The drive for the rotatory system can also be designed as a solid state actuator that, for example, is comprised of a piezoelectric or of a magnetostrictive material.

Due to the magnetic field generated in the electromagnet 26, an electrical torque is exerted on the armature 25 that opposes the torque of the torsion rod 21. As a result of the electrical torque, the shaft 20 together with the stylus holder 24 implements an oscillatory rotatory motion around its longitudinal axis by small angles.

The oscillator rotational movement of the shaft 20 is converted by the stylus holder 24 into a corresponding lifting motion of the engraving stylus 4 in the direction onto the generated surface of the printing cylinder 1, whereby the lifting motion defines the respective penetration depth of the engraving stylus 4 into the printing cylinder 1 dependent on the respective image signal values B.

Due to the arrangement of the shaft 20 parallel to the rotational axis 27 of the printing cylinder 1, the rotatory motion of the stylus holder 24 and the lifting motion of the engraving stylus 4 occurs in a plane 30 perpendicular to the rotational axis 27 of the printing cylinder 1, as a result whereof a symmetrical loading of stylus holder 24 and engraving stylus 4, and thus an improved geometry of the engraved cups, are advantageously achieved when engraving the cups. Moreover, a length variation of the shaft 20 due to a heating does not have a disturbing effect on the cupped geometry, but results in a negligible variation of the web width between the cups.

FIG. 3 shows a sectional view A–B through the engraving element 3 and printing cylinder 1. The stationary electromagnetic element 26 of the drive for the shaft 20 comprises two u-shaped plate packets 31 lying opposite one another that are arranged relative to one another such that air gaps 32 arise between the legs forming the poles. The armature 25 of the rotatory system moves in the air gaps 32. An excitation winding 34 is attached in long parts 33 of the plate packets 31, only one coil side of said winding 34 being shown. The excitation winding 34 is permeated by the engraving control signal (GS).

Figure 4:
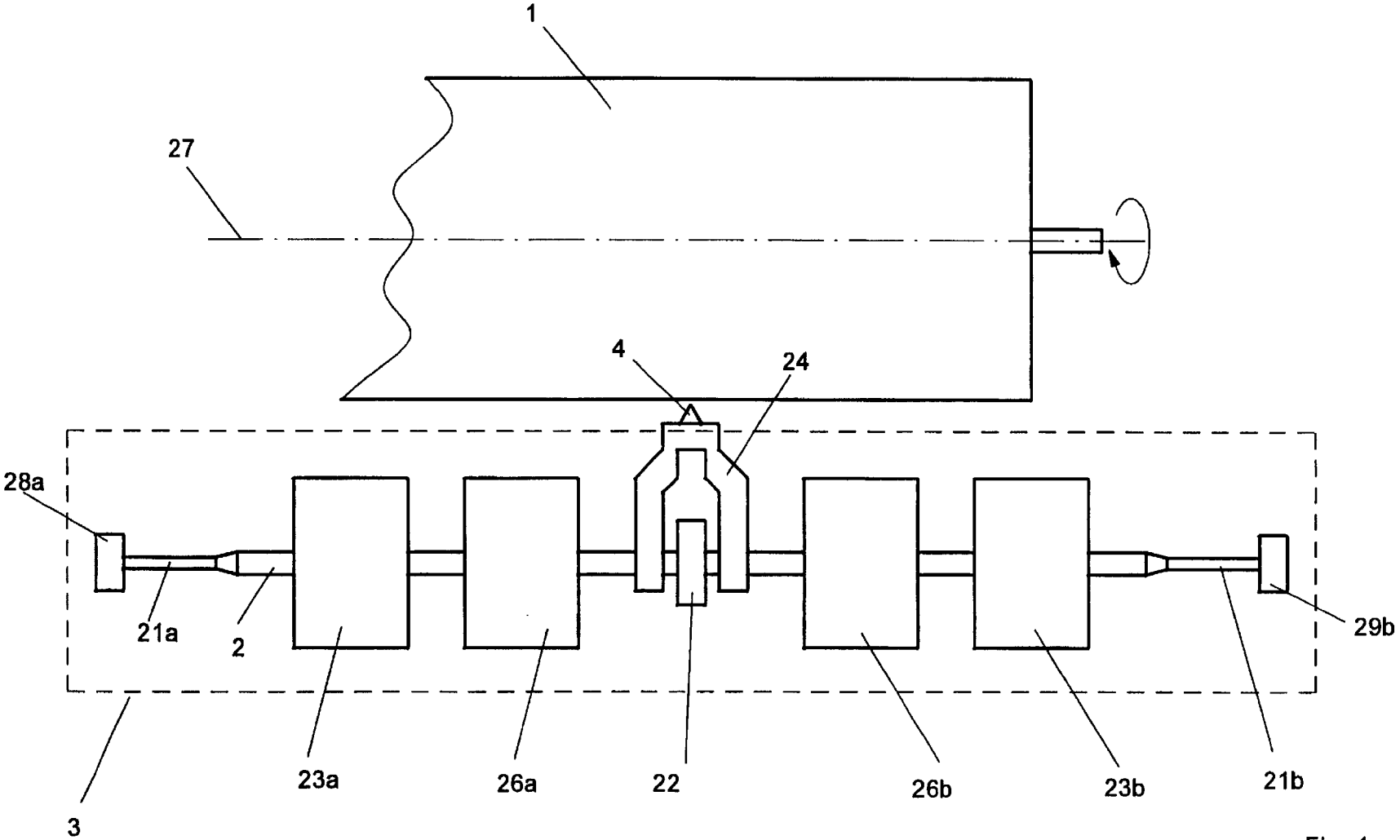
FIG. 4 is a second schematic exemplary embodiment of the engraving element.

FIG. 4 shows a second schematic exemplary embodiment of the engraving element 3 having a mirror-symmetrical structure with respect to the mid-point of the longitudinal axis of the shaft 20. In this exemplary embodiment, both ends of the shaft 20 are designed as torsion rods 21*a*, 21*b* secured in stationary chuckings 28*a*, 28*b*. The stylus holder 24 together with the engraving stylus 4 is designed fork-shaped and attached to the shaft 20 in the mid-point of the longitudinal axis. Two armatures 26*a*, 26*b* and two damping mechanisms 3*a*, 23*b* are present mirror-symmetrically relative to the stylus holder 24. Advantageously, the shaft 20 is also borne in a shaft bearing 22 in the mid-point of its longitudinal axis, whereby the shaft bearing 22 is arranged, for example, in the region of the fork-shaped. stylus holder 24.

The damping mechanism does not effect the shaft 20, but directly acts on the stylus holder 24. Further, torsion rods 21*a*, 21*b* acting as restoring elements can also be replaced by spoke bearings, for example according to German Utility Model Application G 298 12 163.8.

Figure 5:
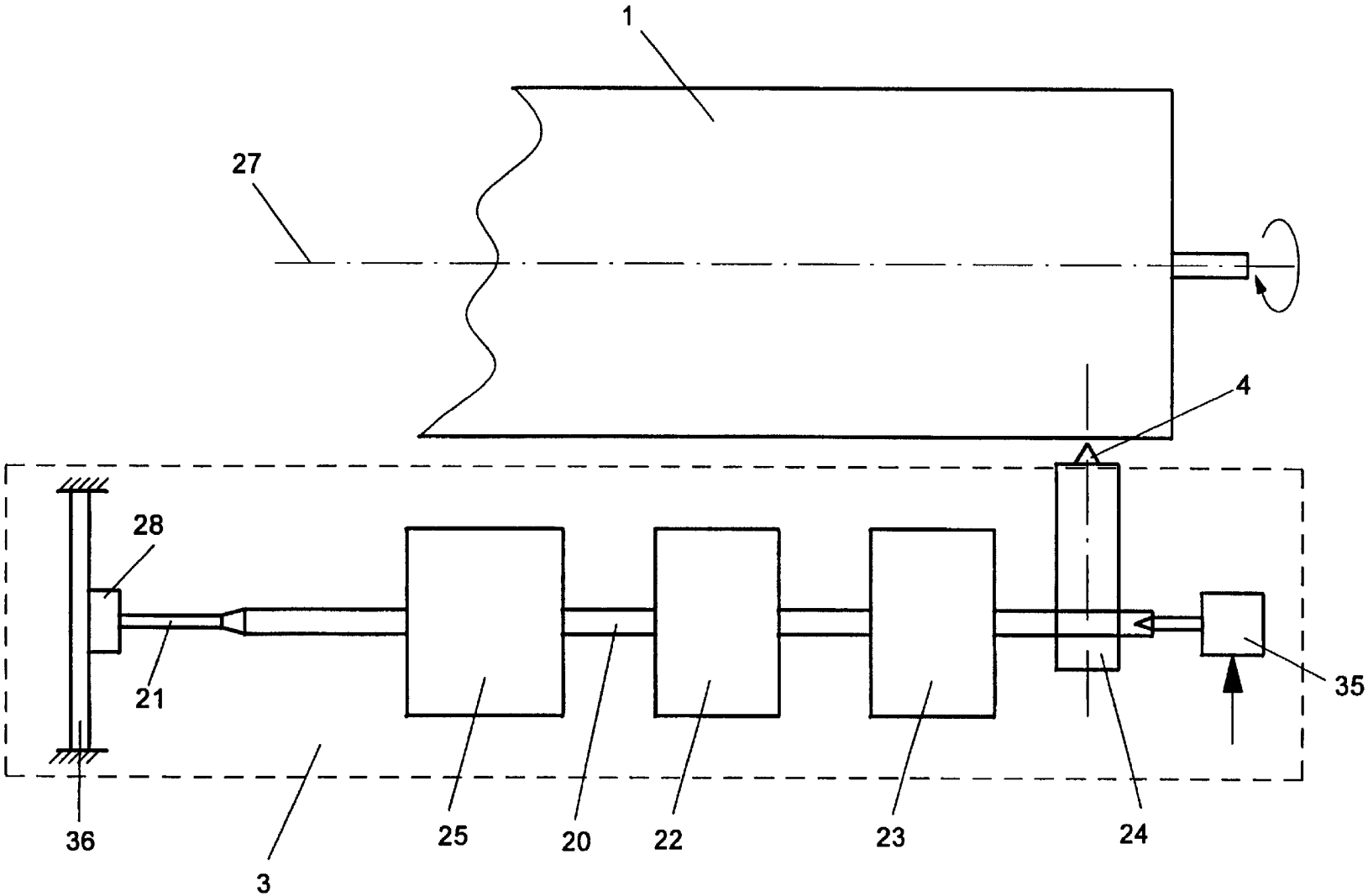
FIG. 5 is a third schematic exemplary embodiment of the engraving element.

FIG. 5 shows a third schematic exemplary embodiment of the engraving element 3 having an electrically controlled setting mechanism 35 for the axial displacement of the rotatory system. In this case, the inherently stationary component parts such as shaft bearing 22, damping mechanism 23 and chucking 28 are seated in anti-twist fashion by suitable resilient elements such as, for example, diaphragms and leaf spring crosses such that a slight axial displacement of the rotatory system and, thus, of the engraving stylus 4 is enabled by the setting device 35 and a return into a quiescent position is also enabled. In FIG. 5, the axial displaceability of the chucking 28 for the torsion rod 21 is indicated, for example with a diaphragm 36. The setting mechanism 35 that, for example, is mechanically coupled to the end face of the shaft 20, can be equipped with a piezo-electric drive.

As a result of the control displacement of the engraving stylus 4, the cups can be engraved on the printing cylinder 1 axially shifted out of their rated positions prescribed by the printing raster and can be displaced into a contour line to be reproduced, as a result whereof a smoothing of the contour line is advantageously achieved in the engraving.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

What is claimed is:

1. An engraving element of an electronic engraving machine for engraving a printing cylinder, comprising:

a shaft oscillating with small rotational angles around a longitudinal axis;

a drive for the shaft;

a lever-shaped stylus holder attached to the shaft and having an engraving stylus as a cutting tool which, for engraving, executes a stroke motion in a direction onto a generated surface of the printing cylinder rotating around a rotational axis;

the engraving element being arranged with respect to the printing cylinder rotating around the rotational axis such that the shaft proceeds substantially parallel to the rotational axis of the printing cylinder; and a stroke motion of the engraving stylus occurring in a plane oriented perpendicular to the rotational axis of the printing cylinder.

2. The engraving element according to claim 1 wherein the stylus holder with the engraving stylus is directed perpendicular to the longitudinal axis of the shaft.

3. The engraving element according to claim 1 wherein a restoring element is arranged at one end of the shaft;

the other end of the shaft carrying the stylus holder with the engraving stylus; and the drive for the shaft, a shaft bearing and a damping mechanism are arranged between the restoring element and the stylus holder.

4. The engraving element according to claim 3 wherein the shaft bearing and the damping mechanism are arranged between the drive for the shaft and the stylus holder.

5. The engraving element according to claim 3 wherein the shaft bearing and the damping mechanism form a structural unit.

6. The engraving element according to claim 3 wherein the end of the shaft lying opposite the stylus holder is designed as torsion rod forming the restoring element, this being secured in a stationary chucking.

7. The engraving element according to claim 3 wherein the end of the shaft carrying the stylus holder is supported by a further shaft bearing.

8. The engraving element according to claim 3 wherein a chucking shaft bearing and the damping mechanism are designed such that the shaft is seated axially displaceable; and the shaft is connected to a controllable actuator for the axial displacement of the shaft.

9. The engraving element according to claim 1 wherein a respective restoring element is arranged at both ends of the shaft with a respective stationary chucking;

the stylus holder with the engraving stylus is attached between the restoring elements; and a respective drive for the shaft and a damping mechanism are arranged at both sides of the stylus holder.

10. The engraving element according to claim 9 wherein the respective drive and the damping mechanism are arranged mirror-symmetrically relative to the central stylus holder.

11. The engraving element according to claim 9 wherein the ends of the shaft are designed as torsion rods forming the restoring elements, these being secured in stationary chucks.

12. The engraving element according to claim 9 wherein at least one shaft bearing is provided in a region of the stylus holder.

13. The engraving element according to claim 3 wherein the shaft bearing comprises a spoke bearing.

14. The engraving element according to claim 1 wherein the drive for the shaft comprises an electromagnetic drive.

15. The engraving element according to claim 14 wherein the electromagnetic drive for the shaft comprises a stationary electromagnet and an armature seated on the shaft.

16. The engraving element according to claim 2 wherein the drive for the shaft comprises a solid state actuator element.

17. The engraving element according to claim 16 wherein the solid state actuator element comprises a piezoelectric or magnetostrictive material.

18. An engraving element of an electronic engraving machine for engraving a printing cylinder comprising:

a shaft oscillating around a longitudinal axis;

a drive for the shaft;

a stylus holder attached to the shaft and having an engraving stylus as a cutting tool which, for engraving, executes a stroke motion in a direction onto a generated surface of the printing cylinder rotating around a rotational axis;

the engraving element being arranged with respect to the printing cylinder rotating around the rotational axis such that the shaft proceeds substantially parallel to the rotational axis of the printing cylinder; and a stroke motion of the engraving stylus occurring in a plane oriented substantially perpendicular to the rotational axis of the printing cylinder.

19. An engraving machine for engraving printing cylinders, comprising a printing cylinder seated rotational around a rotational axis;

an engraving element comprising a shaft oscillating by small rotational angles;

a drive for the shaft;

a stylus holder located at the shaft and having an engraving stylus as a cutting tool;

a restoring element connected to the shaft;

a bearing for the shaft;

a damping mechanism connected at the shaft;

the engraving stylus for engraving, executing stoke motion in a direction of a generated surface of the rotating printing cylinder;

the engraving element being axially displaced along the printing cylinder for planar engraving;

the engraving element being arranged with respect to the printing cylinder rotating around the rotational axis such that the shaft proceeds substantially parallel to the rotational axis of the printing cylinder; and the stoke motion of the engraving stylus occurring in a plane oriented perpendicular to the rotational axis of the printing cylinder.

20. The engraving machine according to claim 19 wherein the stylus holder with the engraving stylus in the engraving element is aligned perpendicular to the longitudinal axis of the shaft.

21. The engraving machine according to claim 19 wherein in the engraving element the restoring element is arranged at one end of the shaft;

another end of the shaft carries the stylus holder with the engraving stylus; and the drive for the shaft, the shaft bearing and the damping mechanism are arranged between the restoring element and the stylus holder.

22. The engraving machine according to claim 21 wherein the shaft bearing and the damping mechanism are arranged between the drive for the shaft and the stylus holder.

23. The engraving machine according to claim 22 wherein the shaft bearing and the damping mechanism form a structural unit.

24. The engraving machine according to claim 21 wherein the end of the shaft lying opposite the stylus holder comprises a torsion rod forming the restoring element, this being secured in a stationary chucking.

25. The engraving machine according to claim 21 wherein the end of the shaft carrying the stylus holder is supported by a further shaft bearing.

26. The engraving machine according to claim 19 wherein the restoring element, the shaft bearing and the damping mechanism are designed such that the shaft is seated axially displaceable; and the shaft is connected to a controllable actuator for the axial displacement of the shaft.

27. The engraving machine according to claim 19, wherein a respective restoring element is arranged at both ends of the shaft;

the stylus holder with the engraving stylus is attached between the restoring elements; and a respective drive for the shaft and a damping mechanism are arranged at both sides of the stylus holder.

28. The engraving machine according to claim 27 wherein the drives and the damping mechanisms are arranged mirror-symmetrically relative to the central stylus holder.

29. The engraving machine according to claim 27 wherein the ends of the shaft are designed as torsion rods forming the restoring elements, these being secured in stationary chucks.

30. The engraving machine according to claim 27 wherein at least one shaft bearing is provided in a region of the stylus holder.

31. The engraving machine according to claim 19 wherein the shaft bearing is designed as a spoke bearing.

32. The engraving machine according to claim 19 wherein the drive for the shaft is designed as an electromagnetic drive.

33. The engraving machine according to claim 32 wherein the electromagnetic drive for the shaft is comprised of a stationary electromagnet and an armature seated on the shaft.

34. The engraving machine according to claim 19 wherein the drive for the shaft is designed as a solid state actuator element.

35. The engraving machine according to claim 34 wherein the solid state actuator element is comprised of one of a piezoelectric and magnetostrictive material.

36. A method for engraving a printing cylinder with an engraving element in an electronic engraving machine, comprising the steps of:

oscillating a shaft around a longitudinal axis;

providing a drive for the shaft;

providing a stylus holder attached to the shaft and having an engraving stylus as a cutting tool, and for engraving executing a stroke motion in a direction onto a generated surface of the printing cylinder which is rotating around a rotational axis;

arranging the engraving element with respect to the printing cylinder such that the shaft proceeds substantially parallel to the rotational axis of the printing cylinder; and stroking the engraving stylus in a plane oriented substantially perpendicular to the rotational axis of the printing cylinder.

* * * * *